US005860699A

United States Patent [19]

Weeks

[11] Patent Number: 5,860,699

[45] Date of Patent: Jan. 19, 1999

[54] ADJUSTABLE LUMBAR SEATING SYSTEM

[75] Inventor: Ryan K. Weeks, Pleasant Ridge, Mich.

[73] Assignee: McCord Winn Textron Inc., Manchester, N.H.

[21] Appl. No.: 914,025

[22] Filed: Jun. 23, 1997

[51] Int. Cl.[6] ..... A47C 3/025

[52] U.S. Cl. ..... 297/284.6; 297/284.3; 297/284.1

[58] Field of Search ..... 297/284.6, 284.3, 297/284.4, 284.1, 200; 5/715, 655.3, 644

[56] References Cited

U.S. PATENT DOCUMENTS

| | | | |
|---|---|---|---|
| 4,807,931 | 2/1989 | Ishida et al. | 297/284.6 |
| 5,280,997 | 1/1994 | Andres et al. | 297/284.6 X |
| 5,320,409 | 6/1994 | Katoh et al. | 297/284.6 |
| 5,606,785 | 3/1997 | Shelberg et al. | 5/715 X |
| 5,637,076 | 6/1997 | Hazard | 297/284.6 X |

FOREIGN PATENT DOCUMENTS

| | | | |
|---|---|---|---|
| 205238 | 12/1982 | Japan | 297/284.6 |

*Primary Examiner*—Laurie K. Cranmer

[57] ABSTRACT

A pneumatically controlled seat for a vehicle has a multiple air cell inflation system which can adjust the pressure in each of the cells simultaneously or sequentially to individually inflate or deflate the cells to a desired pressure level to control the tilt angle of a lumbar support.

6 Claims, 3 Drawing Sheets

ADJUSTABLE LUMBAR SEATING SYSTEM

BACKGROUND OF THE INVENTION

Inflatable air cells have been used in a variety of configurations in the lumbar region of a seat to provide adjustments to the contour of a seat and in this manner enhance the comfort of the individual using the seat. This is especially important in automobiles where long periods of driving can cause pain and distraction or in other seating applications where individuals are sedentary for long periods of time.

The seating system described in U.S. Pat. No. 4,915,124 involves a simple system of multiple air cells in which each cell is connected through a valve to a source of pressurized air in a manner which allows for simultaneous inflation or deflation of the cells in response to a manually operated switch.

Another air cell inflation system is shown in U.S. Pat. No. 5,263,765. This device inflates the air cells according to two predetermined modes, through tubes individually controlled by valves which are in turn controlled by a microcomputer. The microcomputer is responsive to the fatigue of the driver as represented by seat belt displacement.

The air cells of U.S. Pat. No. 4,722,550 are adjusted in response to engine speed or steering angle and allows for selective inflation between two zones of air cells, one at the sides and one for the bottom and back of the seat. One valve controls each of the zones and is actuated by a microcomputer which receives sensed signals relative to the operating parameters of the automobile.

A manually operated power control system for a lumbar cushion is described in U.S. Pat. No. 4,707,027. A complex seating mechanism is devised to allow the operator to inflate and deflate the cushion while sensing pressure in the cushion to limit actuation of the system to prevent damage.

U.S. Pat. No. 4,833,614 shows a system by which an air cell can be inflated to a selected pressure by sensing the actual pressure, comparing it to the pressure selected and then adjusting the air supply to inflate or deflate the air cell to the selected pressure. In this case the microcomputer converts the pressure signal it receives to a time based signal relative to the period necessary to run the pump to obtain the selected pressure. The pressure is sensed directly from sensors within the air support.

U.S. Pat. No. 4,655,505, assigned to NHK Spring Co. Ltd., discloses a pneumatically controlled seat for a vehicle that has a mechanism which can sense the pressure in each air cell remotely in a manifold using one sensor.

The above systems are limited either to narrow preset operational boundaries or rely on the operator to provide a manual interactive response and they do not provide an arrangement in which the lumbar air cells can be separately adjusted to provide a tilt support to a user's back in the vicinity of the lumbar air cells. Although each attempts to improve the comfort of the user and adjust in some manner to the variety of shapes and sizes of the user, each falls short because of the inherent limitations in the particular system.

Another air cell adjustment mechanism of the prior art is shown in U.S. Pat. No. 5,137,329. This patent describes a support structure consisting of front and back plates between which are sandwiched two air cells. The air cells may be selectively inflated and deflated to provide pivoting adjustment motion to the front plate which provides the support contour for the seat.

Tactile adjustment is provided by the air cell of U.S. Pat. No. 4,807,931 which is also mounted in a seat to provide the support contour for directly engaging the lumbar region of the user's back.

However, such prior art does not utilize the positioning of lumbar air cells to provide a tilt adjustment of a lumbar support for adjusting it to a wide variety of users.

SUMMARY OF THE INVENTION

A system of inflatable air cells is constructed and installed in a seat at locations that are strategic to the comfort of the user. The air cells are connected to a pump through a manifold that simultaneously or sequentially, as desired, connects each cell to the pump. The manifold controls the flow of fluid in the air cell distribution system by a system of valves. By sequentially activating individual manifold valves the position of each of the lumbar air cells can be changed to adjust the tilt of the lumbar support to that of an individual user regulate pressure in any air zone. The cells can be individually inflated or deflated to the desired pressure level. By varying the number and location of the cells the system becomes responsive to the localized pressures exerted on the body for a great variety of uses.

One purpose of this invention is to provide a pneumatically controlled seat surface for a vehicle having an array of air cells, each connected to a source of pressurized fluid (air), and arranged in a manner to operate both as an adjustment mechanism for the lumbar support of a seat contour. A fluid distribution system is associated with the array of air cells to provide a simple method of adjusting the lumbar region of a seat to the satisfaction of the user without complex mechanics and while allowing multiple adjustment motions.

Another purpose of this invention is to provide a pneumatically controlled seat for a vehicle having a multiple air cell inflation system which can adjust the pressure in each of the cells simultaneously or sequentially and operatively to individually inflate or deflate the cells to a desired pressure level to control the tilt angle of the lumbar support. This is accomplished in a manner, which minimizes weight, cost, and complexity while maximizing flexibility, reliability, and above all seating comfort.

DESCRIPTION OF THE PREFERRED EMBODIMENTS

Figure 1:
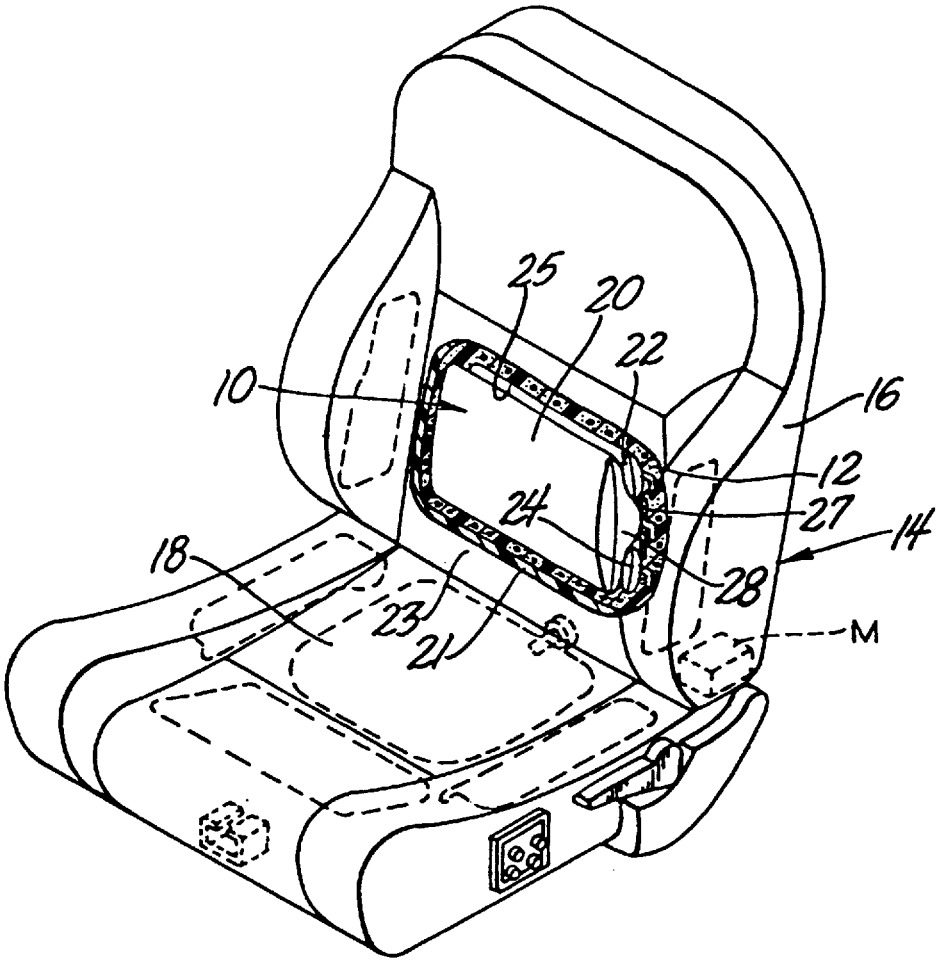
FIG. 1 is a diagrammatic view of an a vehicle seat including the lumbar air cell arrangement of this invention.

In the embodiment of FIG. 1, a nest of air cells 10 is arranged at the lumbar region 12 of a seat 14 having a back 16 and seat portion 18. The nest is comprised of three air cells; a primary or main air cell 20 and secondary air cells 22 and 24. The primary or main air cell 20 is shaped to provide an engagement contour at a covering 21 with a like lumbar region contour surface 23 for the lumbar region 12 of the seat back 14 and is mounted in loose confinement in a pocket 25 in the back 14. The air cell 20 is flexibly fixed to the lumbar region 12 at a support member 27 along a restricted center region 28 of the main air cell 20. The mounted configuration of the main air cell 20 is such as to allow limited pivotal motion about an axis z and a limited lateral or fore and aft motion in a plane parallel to seat back 14. Secondary or top and bottom air cells 22 and 24 are mounted and shaped for operative engagement with the outer extremities of the primary or main air cell 20. The secondary or top and bottom air cells 22, 24 are flexibly mounted to the lumbar region 12 in fixed relationship above and below the pivot axis z of the primary or main air cell 20.

Figure 2:
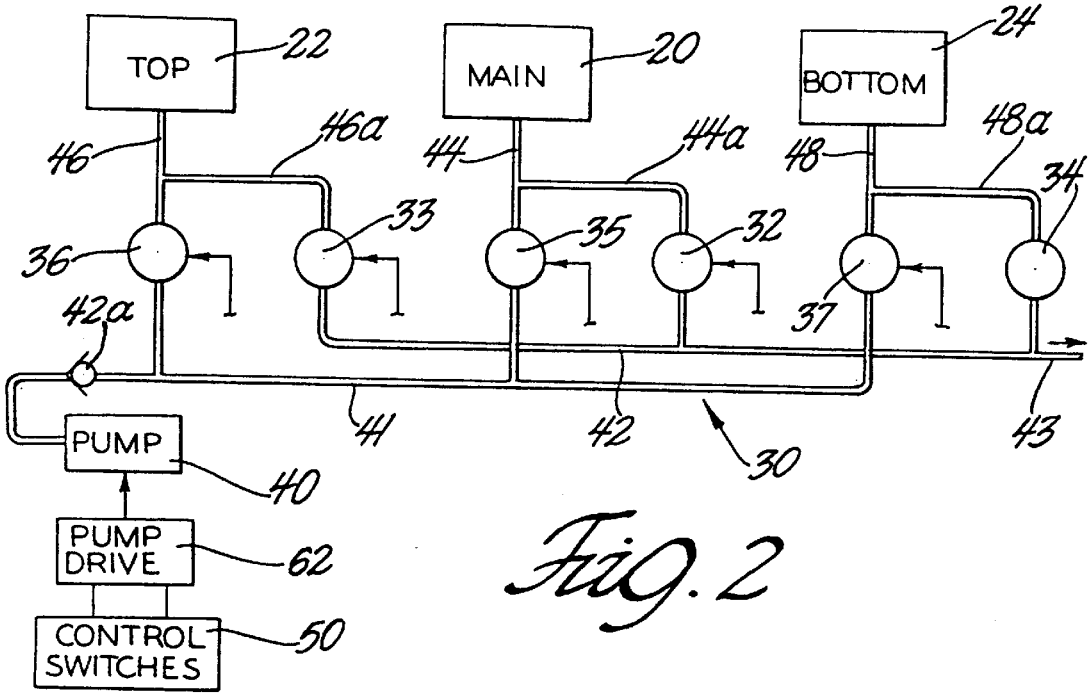
FIG. 2 is a schematic diagram of a pressure supply system of this invention.

A control module M is shown in outline in FIG. 1. It includes a fluid distribution system 30, as seen in FIG. 2. The fluid distribution system 30 is generally comprised of a series of inlet solenoid valves 35, 36, 37 which govern the flow of pressurized fluid into the system from a source of pressurized fluid such as a fluid pump 40 and supply manifold 41 with a check valve 42*a*. Flow out of the system is through a series of outlet solenoid valves 32, 33, 34 and a bleed manifold 42 having a bleed port 43. The air cells 20, 22 and 24 are connected, respectively, to feed tubes 44, 46 and 48 and to branch bleed tubes 44*a*, 46*a* and 48*a*. When the solenoid valves 35, 36, 37 are energized to be open, the cells are connected to the feed tubes 44, 46 and 48 and when the solenoid valves 32, 33, 34 are energized to be open, the cells are connected through the solenoid valves 32, 33, 34 to the bleed port 42. Each valve 32, 33, 34, 35, 36, 37 may be selectively actuated by control switches 50, in a manner to be described, to allow alternate inflation or deflation of the secondary top and bottom cells 22 and 24. For example, as the top cell 22 inflates, the bottom cell 24 will deflate and the opposite happens as bottom cell 24 inflates, the top cell will deflate. This provides a maximum of movement over the range provided by the secondary cells engagement with primary or main cell 20. In this manner, an optimum contour of a lumbar surface can be achieved, customized to the preference of each user.

Figure 3:
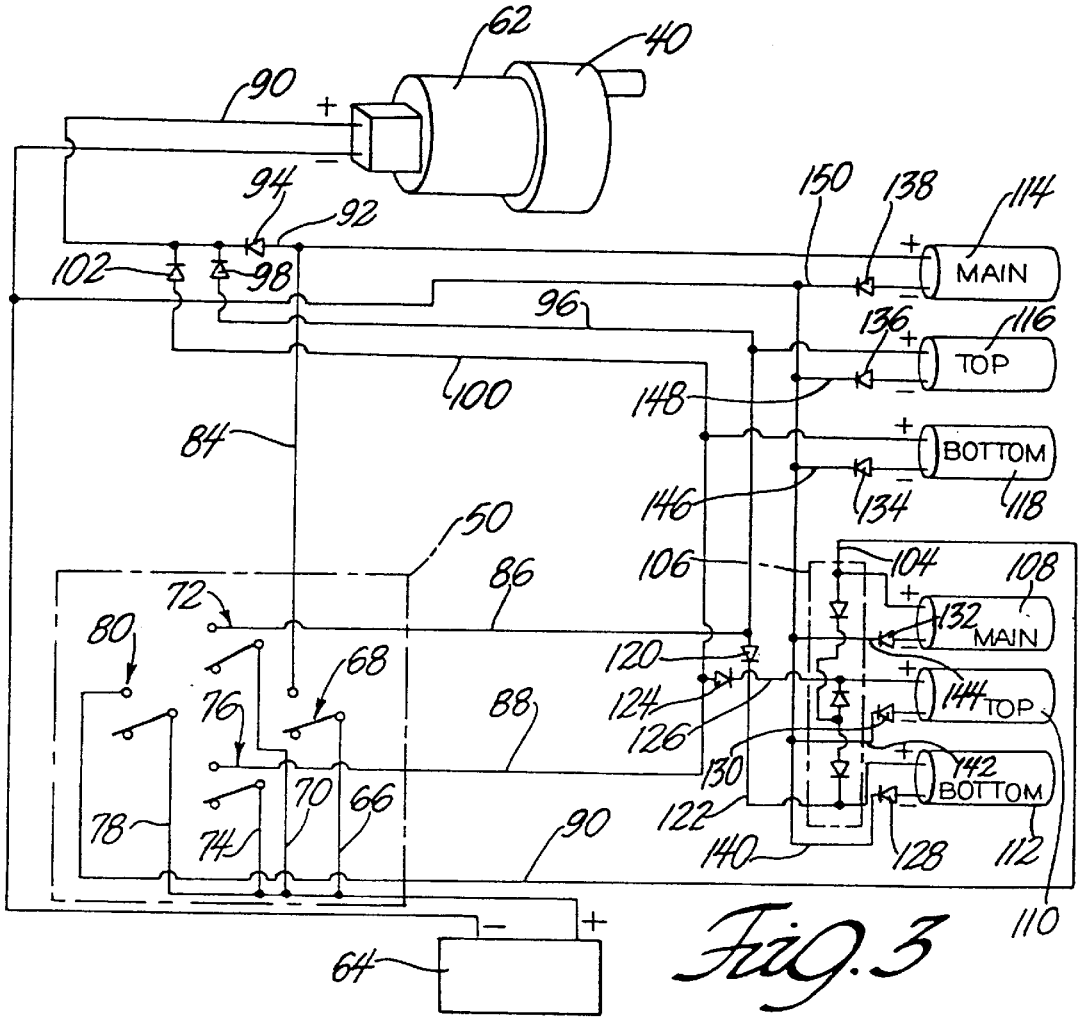
FIG. 3 is a diagrammatic circuit diagram of a controller for the pressure supply system shown in FIG. 2.

More specifically, with reference to FIG. 3, an electrical circuit is illustrated having a power supply 64 to the control switches 50. A first conductor 66 from the power supply 64 is connected to a single pole, single throw "main inflate switch" 68. A second conductor 70 from the power supply 64 is connected to a second single pole, single throw "top pivot" switch 72. A third conductor 74 from the power supply 64 is connected to a third single pole, single throw "bottom pivot" switch 76. A fourth conductor 78 from the power supply 64 is connected to a fourth single pole, single throw "deflate all" switch 80.

When the respective switches are open as shown in FIG. 3, all of the solenoid valves 32, 33, 34, 35, 36, 37 are closed and a drive motor 62 connected to the pump 40 is de-energized.

Positive leads 84, 86, 88 provided from each of the switches 68, 72, 76 are connected respectively through conductors 92, 96, 100 which are connected through diodes 94, 98, and 102 to the positive terminal of the drive motor 62. Specifically, switch 68 connects to a conductor 92 connected through a diode 94 through conductor 90 to the positive terminal of the drive motor 62, and to the main inflate solenoid coil 114. Switch 72 is connected to a conductor 96 connected through diode 98 to conductor 90 to the positive terminal of the drive motor 62, and to a top inflate solenoid coil 116, and to a bottom deflate solenoid coil 112. Switch 76 is connected to a conductor 100 connected through the diode 102 to conductor 90 to the positive terminal of the drive motor 62, and to a top deflate solenoid coil 110, and to a bottom inflate solenoid coil 118. A positive lead 90 provided from switch 80 is connected to a conductor 104 through an array of diodes 106 arranged to supply power concurrently to a main deflate solenoid coil 108; a top deflate solenoid coil 110 and a bottom deflate solenoid 112.

In addition, protective diodes including a diode 120 and a conductor 122 are connected to the bottom deflate solenoid coil 112; and a diode 124 and conductor 126 are connected to the top deflate solenoid coil 110. In addition, protective diodes 128, 130, 132, 134, 136 and 138 are connected to conductors 140, 142, 144, 146, 148 and 150, respectively, which are connected to solenoids 112, 110, 108, 118, 116 and 114, respectively; all of the aforesaid protective diodes are provided to prevent electrical signals from activating solenoids unless they are intended to be open.

Figure 1A:
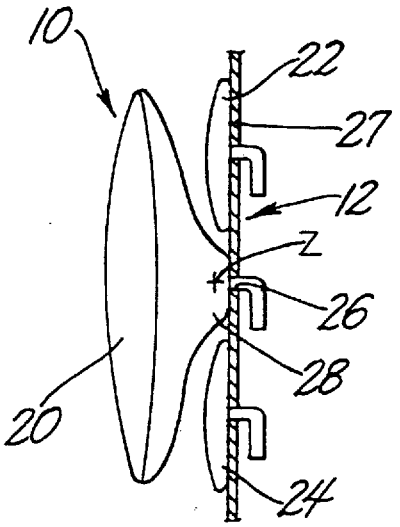
FIGS. 1A–1D are diagrammatic views of the air cell arrangement of FIG. 1 in various operative positions.

By virtue of the aforedesribed circuitry, when the inflate all switch 68 is closed, the pump 40 is driven and the solenoid coil 114 is energized to open solenoid valve 35 so that feed tube 44 is open so that pressurized fluid is directed into the main air cell 20. Thus, the main air cell 20 of air cells 10 is fully expanded outwardly of the lumbar region 12 as diagrammatically shown in FIG. 1A.

Figure 1B:
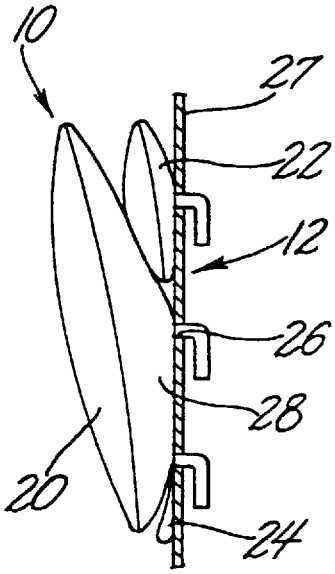

When the top pivot switch 72 is closed, solenoid coils 112, 116 are energized, the feed tube 46 is open via open solenoid valve 36 and the bleed tube 48*a* is open via open solenoid valve 34 such that the inflated main air cell 20 will be tilted forwardly of the lumbar region 12 at its top and will be depressed inwardly of the seat back at its bottom as diagrammatically shown in FIG. 1B.

Figure 1C:
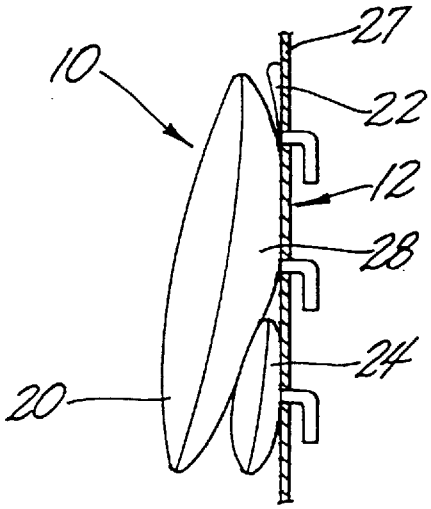

When the bottom pivot switch 76 is closed, the solenoid coils 110, 118 are energized, feed tube 48 is open via the open solenoid valve 37 and the bleed tube 46*a* is open via the open solenoid valve 33 such that the inflated main air cell 20 will be tilted forwardly of the lumbar region 12 at its bottom and will be depressed inwardly of the seat back at its top as diagrammatically shown in FIG. 1C.

Figure 1D:
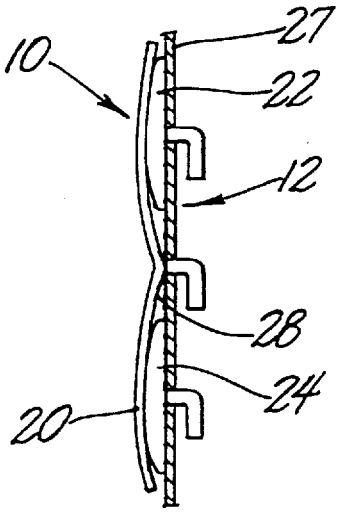

When the deflate all switch 80 is closed, the deflate coils 108, 110 and 112 are all energized such that the solenoid valves 32, 33, 34 are open to cause the air cell nest 10 to be fully deflated as shown in FIG. 1D.

While the best modes for carrying out the invention have been described herein in detail, those familiar with the art to which this invention pertains will recognize various alternative designs and embodiments for practicing the invention are possible within the scope of the following claims.

What is claimed is:

1. A system for adjusting the contour of the lumbar region of a seat comprising:

a. a seat having a back portion including a lumbar region contour surface for the support of the back of a user;

b. a primary air cell mounted within said back portion in engaging support with said lumbar region contour surface;

c. a plurality of secondary air cells mounted within said back portion in operative engagement with said primary air cell to provide adjustable movement thereof;

d. a control module connected to allow a selective flow of fluid to and from said primary air cell and said plurality of secondary air cells;

e. a source of pressurized fluid connected to each of said primary air cell and said plurality of secondary air cells through said control module;

f. a bleed port connected to each of said primary air cell and said plurality of secondary air cells;

g. a first switch system operatively connected to said control module to selectively initiate the flow of fluid into said primary air cell;

h. a second switch system operatively connected to said control module to selectively initiate the flow of fluid into at least one of said secondary air cells and simultaneously out of at least one other of said secondary air cells to adjust the shape of said contour surface; and i. said primary air cell being located between said lumbar region contour surface and said plurality of secondary air cells; said secondary air cells including two air cells located against said primary air cell and said second switch system controlling flow of fluid to and from said two air cells to cause said primary air cell to tilt with respect to said contour surface.

2. The system for adjusting the contour of the lumbar region of a seat of claim 1 further comprising: said primary air cell having a center region fixed with respect to said seat back; one of said two air cells being located above said center region and the other of said two air cells being located below said center region and said second switch system controlling flow of fluid to and from said two air cells to cause said primary air cell to tilt about said center region.

3. The system for adjusting the contour of the lumbar region of a seat of claim 2 further comprising said second switch system operative to cause said one of said two air cells to inflate when said other of said two air cells is deflated.

4. The system for adjusting the contour of the lumbar region of a seat of claim 1 further comprising: said control module including a deflate all switch that will cause said primary air cell and said plurality of secondary air cells to concurrently deflate for collapsing said lumbar region contour surface.

5. The system for adjusting the contour of the lumbar region of a seat of claim 1 wherein said control module includes a manually operative deflate all switch for causing said primary air cell and said secondary air cells to fully deflate for causing said contour surface to be shifted laterally inwardly with respect to said seat back.

6. The system for adjusting the contour of the lumbar region of a seat of claim 1 wherein said control module includes a manually operative deflate switch for one of said secondary air cells for deflating said one of said secondary air cells for causing said primary air cell to tilt inwardly of said seat back at said one of said secondary air cells for causing said contour surface to be shifted laterally inwardly with respect to said seat back at said one of said secondary air cells.

* * * * *